US008465900B2

(12) United States Patent
Kubo

(10) Patent No.: US 8,465,900 B2
(45) Date of Patent: Jun. 18, 2013

(54) ELECTROPHOTOGRAPHIC TONER

(75) Inventor: Masahiko Kubo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 283 days.

(21) Appl. No.: 12/912,343

(22) Filed: Oct. 26, 2010

(65) Prior Publication Data

US 2011/0097658 A1 Apr. 28, 2011

(30) Foreign Application Priority Data

Oct. 27, 2009 (JP) ..... 2009-246919

(51) Int. Cl.
*G03G 9/08* (2006.01)

(52) U.S. Cl.
USPC ..... 430/124.4; 430/111.4; 430/109.4

(58) Field of Classification Search
USPC ..... 430/109.4, 111.4, 124.4; 399/252, 399/336
See application file for complete search history.

(56) References Cited

U.S. PATENT DOCUMENTS

| | | | | |
|---|---|---|---|---|
| 5,578,408 | A | 11/1996 | Kohtaki et al. | |
| 6,040,104 | A * | 3/2000 | Nakamura et al. | 430/109.4 |
| 7,169,524 | B2 | 1/2007 | Nakamura et al. | |
| 2002/0192586 | A1 | 12/2002 | Kubo et al. | |
| 2006/0063087 | A1 | 3/2006 | Ninomiya et al. | |

FOREIGN PATENT DOCUMENTS

| | | |
|---|---|---|
| CN | 1752854 A | 3/2006 |
| JP | 04-012367 | 1/1992 |
| JP | 06-110245 | 4/1994 |
| JP | 11-038667 | 2/1999 |
| JP | 2002-311643 | 10/2002 |
| JP | 2004-020861 | 1/2004 |
| JP | 2005-17442 | 1/2005 |
| JP | 2008-089828 | 4/2008 |
| JP | 2008-107576 | 5/2008 |

* cited by examiner

*Primary Examiner* — Mark A Chapman

(74) *Attorney, Agent, or Firm* — Nixon & Vanderhye P.C.

(57) ABSTRACT

The present invention provides an electrophotographic toner comprising a polyester resin as binder resin and a colorant, said polyester resin being the condensation product of at least one polyhydric alcohol with at least one polybasic acid, wherein said at least one polyhydric alcohol comprises cyclohexanedimethanol, said toner having a loss modulus of from $2\times10^3$ Pa to $3\times10^4$ Pa at 110° C. and being irradiated with only laser light for fixing. According to toner of the invention, high quality toner images can be fixed with desired fastness and without white spots.

7 Claims, 2 Drawing Sheets

ELECTROPHOTOGRAPHIC TONER

CROSS-REFERENCE TO RELATED APPLICATION

This application is related to Japanese Patent Application No. 2009-246919 filed on Oct. 27, 2009, whose priority is claimed under 35 USC §119, the disclosure of which is incorporated herein in its entirety by reference for any and all purposes.

BACKGROUND OF THE INVENTION

1. Field of the Invention

The present invention relates to an electrophotographic toner and a developer comprising the same. The invention also relates to a fixing process and a fuser unit for fixing a toner image made with said toner, and an image-forming apparatus using said toner.

2. Description of the Related Art

In electrophotographic image-forming processes, generally, an electrophotographic image is formed by the steps of forming an electrostatic latent image on a photoreceptor drum by use of photoelectric effects, developing the latent image with toners into a toner image (a visible image), transferring and fixing the toner image onto a recording paper.

The fixation is performed by a fuser unit using heat, pressure, light or the like. One of the most commonly-used fuser units uses a heated roller.

Although a fuser unit using a heated roller has a high heat efficiency, the heated roller takes several tens of seconds for the initial heating (starting-up), and it is likely that residual toners on the roller are offset transferred onto a recording paper. In addition, since the roller nips a recording paper, papers fed continuously are likely to wrinkle or break by snaking their way.

A pressure fuser unit draws attention, since it has no use for warming-up and a heat source. However, it has difficulty in firmly fixing a toner image on a recording paper. In addition, since pressure is applied to a recording paper between a pair of rollers, the paper is likely to wrinkle or tear by snaking its way. Furthermore, in the case of using as a recording paper a stick-on label, which is frequently used in these days, the adhesive can be pressed out.

A light fuser unit can fix a toner image rapidly, since the toners forming the toner image are fused by absorbing selectively the energy of flash light from the light source, such as a xenon lamp, of the unit. Since such a fuser unit does not need to contact a recording paper, a toner image on the paper can be fixed without offset transferring toners onto the paper, wrinkling or tearing the paper resulting from snaking, or pressing out the adhesive in case of using a stick-on label.

In flash light fixing, black toners absorb light of all wavelengths and thus can be fused sufficiently and fixed firmly by absorbing strong near-infrared light in a range of 800 to 1000 nm from a xenon lamp, but color toners such as cyan, magenta and yellow toners hardly absorb such near-infrared light and therefore are fused insufficiently.

In this view, Japanese Kokai (laid-open) Patent Publication No. Hei 11-38667 (1999) proposes the addition of such an infrared-absorbent that absorbs near-infrared light to color toners.

However, infrared-absorbents having a strong absorption peak in the near-infrared region also absorb light of less than 780 nm in the visible region. Therefore, if toners contain a sufficient amount of such absorbents to be fused sufficiently by near-infrared light, toner images made with the toners are poor in color reproducibility due to absorption of light in the visible region.

In order to reduce the amount of infrared-absorbents to be added, Japanese Kokai (laid-open) Patent Publication No. 2008-107576 proposes a fixing process and a fuser unit with increased heat supply efficiency, in which flash light fixing is combined with laser light fixing wherein laser beams are specific for the used color toners respectively, that is, the wavelengths of the laser beams match the maximum absorption wavelengths of the respective color toners.

Japanese Kokai (laid-open) Patent Publication No. 2005-17442 describes that by limiting, to a given range of values, the viscoelasticity of toners containing infrared absorbents used for non-contact fixing (flash light fixing), a toner image made with the toners can be fixed with low energy and also white spots are prevented from occurring in the image.

The method described in the '576 publication does not significantly decrease the amount of infrared-absorbents added to toners and toner images made with such toners are poor in color reproducibility. In addition, since the fuser unit using said method requires a flash light unit and a laser light unit, it has a complex structure and thus is expensive to produce.

The '442 publication describes only the necessary viscoelasticity of toners containing infrared-absorbents for preventing white spots from occurring in a non-contact (flash light) fixed toner image. It does not describe about how to prevent white spots from occurring in a non-contact fixed toner image that is made with toners not containing an infrared-absorbent, which behave under light irradiation differently from toners containing an infrared-absorbents.

SUMMARY OF THE INVENTION

An objective of the present invention is to provide an electrophotographic toner capable of forming a toner image that has good color reproducibility and that can be fixed without white spots and with sufficient fastness by only laser light fixing.

Another objective is to provide an electrophotographic single- or two-component developer comprising said toner.

Another objective is to provide a fixing process for fixing a toner image made with said toner on a recording material.

Another objective is to provide a fuser unit (or a fixing unit) for fixing an image made with said toner and an electrophotographic image-forming apparatus using said toner and comprising said fuser unit.

Accordingly, the present invention provides an electrophotographic toner comprising a polyester resin as binder resin and a colorant, said polyester resin being the condensation product of at least one polyhydric alcohol with at least one polybasic acid, wherein said at least one polyhydric alcohol comprises cyclohexanedimethanol, said toner having a loss modulus of from $2\times10^3$ Pa to $3\times10^4$ Pa at 110° C. and being irradiated with only laser light for fixing.

The invention also provides an electrophotographic developer comprising the above-mentioned toner.

The invention also provides a fixing process for electrophotography, comprising the steps of: fusing a toner forming an unfixed toner image on a recording medium by irradiation with a laser light beam, wherein said toner is the above-mentioned toner and said laser light beam has a wavelength within an absorption band of the colorant contained in said toner; and fixing said toner image onto said recording medium by re-solidifying said toner.

The invention also provides a fuser unit for electrophotography, comprising a laser light source for emitting a laser light beam to an unfixed toner image on a recording medium, thereby heat-fusing a toner forming said toner image, wherein said toner is the above-mentioned toner, and said laser light beam has a wave length within an absorption band of the colorant contained in said toner.

The invention further provides an electrophotographic image-forming apparatus that uses the above-mentioned developer and comprises the above-mentioned fuser unit.

BRIEF DESCRIPTION OF THE DRAWINGS

The present invention will become more fully understood from the detailed description provided herein below and the accompanying drawings which are given by way of illustration only, and wherein.

DETAILED DESCRIPTION OF THE INVENTION

Figure 1:
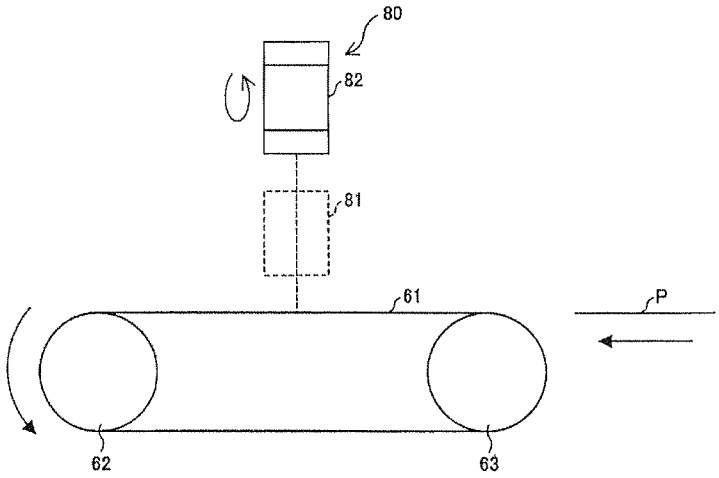
FIG. 1 is a schematic cross-sectional view illustrating an embodiment of a fuser unit according to the invention.

Before the present invention is described in detail, it must be noted that, as used herein and in the appended claims, the singular forms "a", "an" and "the" include plural referents unless the context clearly dictates otherwise.

Electrophotographic Toner

The electrophotographic toner according to the invention is a toner that comprises a polyester resin as binder resin and a colorant, has a loss modulus of from $2\times10^3$ Pa to $3\times10^4$ Pa at 110° C. and is irradiated with only laser light for fixing. Said polyester resin is the condensation product of at least one polyhydric alcohol with at least one polybasic acid, wherein the at least one polyhydric alcohol comprises cyclohexanedimethanol.

In order to fix a toner image made with toners not comprising an infrared absorber with good fastness by only laser light, it is necessary that the toner has a large ratio of loss modulus to storage modulus (loss modulus/storage modulus: tan δ; a material tends to exhibit an elastomeric behavior as the ratio is smaller and a viscous behavior as the ratio is larger) and also a low viscosity.

If a toner comprises a commonly-used polyester as a binder resin and has too low elasticity and viscosity, a toner image made with the toner is fixed with white spots (circular or elliptic white blanks appearing in a color image fixed by non-contact heat fixing or fusing). White spots are thought to occur in a color toner image by lightening the color due to the appearance of bulk of air in the surface from the inside of the image as the result of instant over-fusing and subsequent flow of the toners forming the image.

In the toner according to the invention, fine crystal portions, which can prevent from over-fusing and flow of the toner, are dispersed throughout the binder resin. Thus, the present toner is ensured to be fixed firmly by only laser fixing or fusing, that is, there is no need to include an infrared-absorbent in the toner. In addition, the toner is fixed without occurrence of white spots.

The value of tan δ is preferably from 8 to 20. If it is less than 8, the toner tends to be so elastic to be difficult to fix. If greater than 20, white spots tend to occur in a toner image made with the toner in fixing.

(Binder Resin)

The present toner comprises, as binder resin, a polyester resin that is the condensation product of at least one polyhydric alcohol with at least one polybasic acid, wherein the at least one polyhydric alcohol comprises cyclohexanedimethanol. Preferably, the at least one polyhydric alcohol comprise 5 to 60 mole % of 1,4-cyclohexanedimethanol with respect to the total moles of the at least one polyhydric alcohol. More preferably, the at least one polyhydric alcohol comprises 1,4-cyclohexanedimethanol and an alkylene oxide adduct, such as polyoxyethylene (2 moles) or polyoxypropylene (2 moles) adduct, of bisphenol A.

In addition to 1,4-cyclohexanedimethanol (and bisphenol A alkylene oxide adducts), the at least one polyhydric alcohol may comprise one or more other polyhydric alcohol that are commonly-used in the art for preparing polyester resins for toners, including those descried below for an additional polyester resin.

The at least one polybasic acid comprises any of the polybasic acids commonly-used for preparing polyester resins for toners, including for example dibasic acids such as succinic acid, adipic acid, sebacic acid, azelaic acid, dodecenyl succinate, n-dodecyl succinate, malonic acid, maleic acid, fumaric acid, citraconic acid, itaconic acid, glutaconic acid, cyclohexanedicarboxylic acid, orthophthalic acid, isophthalic acid, terephthalic acid; tribasic or higher polybasic acids such as trimellitic acid, trimesic acid, pyromellitic acid; anhydrides or lower alkyl esters of the foregoing and others. Among them, terephthalic acid and lower alkyl esters thereof are preferable in view of resistance to thermal aggregation.

The toner may further comprise, as binder resin, any other polyester resin commonly-used in the art than the polyester resins that comprise a polyhydric alcohol component derived from cyclohexanedimethanol or polyhydric alcohol components derived from cyclohexanedimethanol and a bisphenol A alkylene oxide adduct.

Polyhydric alcohols for such an additional polyester resin include, for example, those derived from dihydric alcohols such as ethylene glycol, triethylene glycol, 1,2-propylene glycol, 1,3-propylene glycol, 1,4-butanediol, 1,3-butanediol, 1,4-butenediol, 1,5-pentanediol, 1,6-hexanediol, hydrogenated bisphenol A; a trihydric or higher polyhydric alcohol such as glycerol, trimethylolethane, trimethylolpropane, tris (hydroxy)ethyl isocyanurate, pentaerythritol.

Polybasic acids for the additional polyester resin include for example those described above.

In the present toner, the binder resin may be a blend resin of the polyester resin(s) with any other resin that is commonly-used as a binder resin in a toner, such as styrene acrylic resin, epoxy resin, petroleum resin and/or the like.

(Colorant)

As colorant, any pigments or dyes, preferably pigments, can be used which are known to be used for toners. Pigments have better light-resistance and better coloring power than dyes.

The colorants include those for yellow toner, magenta toner, cyan toner, black toner and the like.

The colorants for yellow toner include, for example, organic pigments such as C.I. Pigment Yellow 1, C.I. Pigment Yellow 5, C.I. Pigment Yellow 12, C.I. Pigment Yellow 15, and C.I. Pigment Yellow 17, C.I. Pigment Yellow 74, C.I. Pigment Yellow 93, C.I. Pigment Yellow 180, C.I. Pigment Yellow 185; inorganic pigments such as yellow iron oxides and yellow ocher; nitro dyes such as C.I. Acid Yellow 1; oil-soluble dyes such as C.I. Solvent Yellow 2, C.I. Solvent Yellow 6, C.I. Solvent Yellow 14, C.I. Solvent Yellow 15, C.I.

Solvent Yellow 19 and C.I. Solvent Yellow 21, as classified according to Colour Index Generic Names.

The colorants for magenta toner include, for example, C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10 and C.I. Disperse Red 15, as classified according to Colour Index Generic Names.

The colorants for cyan toner include, for example, C.I. Pigment Blue 15, C.I. Pigment Blue 16, C.I. Solvent Blue 55, C.I. Solvent Blue 70, C.I. Direct Blue 25, and C.I. Direct Blue 86, as classified according to Colour Index Generic Names.

The colorants for black toner include, for example, carbon black such as channel black, roller black, disc black, gas farness black, oil farness black, thermal black and acetylene black and the like.

The present toner may comprise any other colorants such as red pigments and green pigments can be used. In the toner, a single colorant may be used alone, or two or more similar or different colorants may be used in combination.

The total content of the colorant(s) in the toner is not limited, but preferably from 4 to 20 parts by weight with respect to 100 parts by weight of the binder resin. This range of the colorant content makes it possible to obtain the toners that decrease in filler effects resulting from the addition of the colorant while having high coloring power. If the content is more than 20 parts by weight, it is likely that the fastness of the toner is reduced due to the filler effect of the colorant.

The toner may comprise any other additives that are commonly used for toners, such as external additives (or fluidizing agents), release agents, charge control agents.

(External Additives)

As external additive, inorganic particulates can be used so as to improve fluidity and/or chargeability of the toner.

The inorganic particulates have preferably a primary particle size of 5 nm to 2 μm, and more preferably 5 nm to 500 nm. The BET specific surface area of the inorganic particulates is preferably from 20 to 500 $m^2/g$.

Specific examples of the inorganic particulates include silica, titanium oxide, or alumina, barium titanate, magnesium titanate, calcium titanate, strontium titanate, zinc oxide, tin oxide, quartz sand, clay, maica, wollastonite, diatomite, chromium oxide, cerium oxide, colcothar, antimony trioxide, magnesium oxide, zirconium oxide, barium sulphate, barium carbonate, calcium carbonate, silicon carbide, silicon nitride and the like.

In the present toner, a single inorganic particulate may be used alone, or two or more inorganic particulates may be used in combination.

The external additives inorganic particulates may be hydrophobized by treating their surface with a surface treatment agent. It is preferred to use such hydrophobic inorganic particulates since they can prevent from decrease in the fluidity and chargeability of the toner under high humidity environments. Preferable surface treatment agents include silane-coupling agents, silylation agents, silane coupling agents having a fluorinated alkyl group, titanate coupling agents and aluminate coupling agents, silicone oils, modified silicone oils and the like.

(Charge Control Agent)

A charge control agent may be added in the toner in order to provide suitable chargeability. As charge control agent, any of the commonly-used negative and positive control agents for toner can be used.

The positive charge control agents include, for example, nigrosine dyes, basic dyes, quaternary ammonium salts, quaternary phosphonium salts, aminopyrine, pyrimidine compounds, polynuclear polyamino compounds, aminosilane, nigrosine dyes and derivatives thereof, triphenyl methane derivatives, guanidine salts, amidine salts, and the like.

The negative charge control agents include, for example, oil-soluble dyes such as oil black and spiron black; metal-containing azo compounds, azo complex dyes, metal naphthenate, salicylic acid and meal complexes and metal salts of derivatives thereof (the metals include chromium, zinc, zirconium and the like), boron compounds, fatty acid soaps, long chain alkyl carboxylates, resin soaps, and the like.

In the toner, a single charge control agent may be used alone, or two or more charge control agents may be used in combination.

The total content of the charge control agent in the toner is preferably from 0.5 to 5 parts by weight and more preferably 0.5 to 3 parts by weight, with respect to 100 parts by weight of the binder resin.

When the toner is used in a two-component developer, if the content is more 5, then the carriers are contaminated and as the result toner fogging occurs. If the content is less 0.5, the toner does not have good chargeability.

The addition of an infrared-absorbent in a toner can result in too low viscosity, causing the occurrence of white spots in the fixed toner image. Thus, preferably, the present toner does not substantially comprise an infrared-absorbent. In this context, the expression "not substantially comprise" is intended to mean that the toner does not comprise an infrared-absorbent in an amount that it affects the viscosity of the toner. Such an amount is, for example, 0.1 parts by weight or less, with respect to 100 parts by weight of the total binder resins.

<Manufacturing Process>

A process for manufacturing the present toner is not limited. The toner may be manufactured by any method known in the art, such as a dry and or process.

For example, the toner can be manufactured by a melt-kneading and pulverizing process, which comprises the following the steps of: dry mixing a toner material comprising a polyester binder resin and a colorant and optionally a charge control agent and/or any other additive; melt-kneading the obtained mix, cooling and solidifying the melt-kneaded product; mechanically pulverizing the solidified product, and classifying the resulting particles and removing particles having undesired sizes.

The colorant is preferably added as master batch. The master batch can be manufactured by, for example, kneading a molten binder resin and the colorant. In the master batch, the resin can be used which is of the same kind as, or highly compatible with, the binder resin of the toner. The content of the colorant and the binder resin in a master batch is not limited, but preferably is 30 to 100 parts by weight of the colorant with respect to 100 parts by weight of the binder resin. The average size of particles in the master batch is not limited, but it is preferable if the mater batch is granulated into particles having a size of around 2 to 3 mm.

For the dry mixing, any known dry mixers can be used, including Henschel-type mixers such as HENSCHEL MIXER (Mitsui Mining Co., Ltd., Japan), SUPER MIXER (Kawata MFG Co., Ltd., Japan), MECHANOMILL (Okada Seiko Co., Ltd., Japan); ANGMILL (Hosokawa Micron Corporation, Japan), HYBRIDIZATION SYSTEM (Nara Machinery Co., Ltd., Japan), and COSMOSYSTEM (Kawasaki Heavy Industries, Ltd., Japan) and the like.

In the melt-kneading step, the mix obtained in the mixing step is kneaded while heating at a temperature equal to or higher than the melting point of the binder resin. The "temperature equal to or higher than the melting point of the binder resin" is usually approximately 80 to 200° C., and preferably approximately 100 to 150° C.

For melt-kneading, any commonly-used kneaders can be used, including single or twin screw extruders such as TEM-100B (Toshiba Machine Co., Ltd., Japan), PCM-65/87 (Ikegai Corporation, Japan) and LABOPLAST MILL, open roll kneaders, such as KNEADEX (Mitsui Mining Co., Ltd., Japan), triple roll mills, and the like.

For pulverizing, cutting mills, feather mills, jet mills and the like can be used, whether alone or in combination. For example, the solidified product can be pulverized roughly by a cutting mill and then more finely by a jet mill so as to obtain core particles of a desired volume average particle size.

In the classifying step, obtained particles are classified so as to remove too small particles and obtain toner particles having a desired volume average particle size. As a classifier, any of the commercially-available classifiers can be used, including rotary classifiers such as TSP separator (Hosokawa Micron Corporation, Japan) and the like.

<Developer>

The developer according to the present invention can be either a single- or two-component developer comprising the present toner as described above.

In an embodiment, the developer is a single-component developer comprising the above-mentioned toner alone. Such a single-component developer is friction-charged so as to adhere on a developing sleeve by a blade or a fur brush and carried by the sleeve for forming a toner image. In this embodiment, the toner may comprise an external additive attached thereto.

In another embodiment, the developer is a two-component developer comprising the above-mentioned toner, which has high efficiency of light absorption, and a carrier. Such a two-component developer can form a toner image with good color reproducibility, and the toner image can be fixed firmly over a long period of time.

As carriers, any of the commonly-used carriers can be used, including for example, single or composite ferrites comprising iron, copper, zinc, nickel, cobalt, manganese, chromium or the like; resin-coated carriers composed of core particles and coating materials thereon, dispersion-type carriers composed of resin core particles and magnetic powers dispersed therein, and the like.

Coating materials used for the resin-coated carries are not limited. Any coating materials known in the art can be used, including for example polytetrafluoroethylene, monochlorotrifluoroethylene polymers, polyvinylidene fluorides, silicon resins, polyester resins, metallic compounds of di-tert-butylsalicylic acid, styrene resins, acrylic resins, polyacids, polyvinylrals, nigrosine, aminoacrylate resins, basic dyes, and lake products of basic dyes, and fine silica and alumina powders.

Resins used in the dispersion-type carrier includes, but not limited to, styrene-acrylic resins, polyester resins, fluorocarbon resins and phenol resins.

It is preferable that the resin is selected appropriately according to the components of the toner. A single resin may be used alone, or two or more resins may be used in combination.

The carrier is preferably in the shape of sphere or oval. The particle size of carriers is not limited, but ranges preferably from 10 to 100 μm, and more preferably from 20 to 50 μm, in view of high image quality. The resistivity of the carriers is preferably $10^8$ Ω·cm or more, and more preferably $10^{12}$ Ω·cm or more.

The volume resistivity of the carriers, as used herein, is intended to mean a value determined according to the following manner. The carriers are filled in a container having a sectional area of 0.50 $cm^2$ and an electrode at the bottom, with tapping it. When, while pressing the carriers at 1 $kg/cm^2$ with an electroconductive weight, a voltage is applied between the weight and the bottom electrode so as to generate an electric field of 1000 $V/cm^2$, the electric current therebetween is measured. The electric current is used to determine the resistivity.

If the resistivity is too low, it is likely that when the bias voltage is applied to the developing sleeve, the carriers are charged and thus easily travel to the photoreceptor and also the bias voltage easily breaks down.

Magnetization intensity (maximum magnetization) of the carriers ranges preferably from 10 to 60 emu/g and more preferably 15 to 40 emu/g. Appropriate magnetization intensity depends on the magnetic flux density of the developing roller used. Under the magnetic flux density used commonly for developing roller, if the magnetization intensity is less than 10 emu/g, it is likely that the carriers scatter due to the lack of magnetic constraint. If the magnetization intensity is more than 6 emu/g, it is likely that the magnetic brush of the carriers is too high to prevent from contacting it with the photoreceptor in the case of non-contact developing, and that sweep lines appear in the toner image in the case of contact developing.

The content of the toner and a carrier in a two-component developer is not limited. It can be determined appropriately according to the kinds of toner and carrier to be used. For example, if a resin-coated carrier (having a density of 5 to 8 $g/cm^3$) is used, the developer comprises 2 to 30% by weight, and preferably 2 to 20% by weight of the toner based on the total weight of the developer. The surface coverage of the carrier with toners is preferably from 40 to 80%.

The toner may have an external additive attached thereto.

The external additive is attached to the toner by mixing the toner and the external additive in a Henschel mixer or the like.

The amount of the external additive to be added is preferably from 1 to 10 parts by weight, and more preferably 5 parts by weight or less, with respect to 100 parts by weight of the toner particles, in view of the charge required for the toner, the effects of the external additive on abrasion of the photoreceptor, the environmental characteristics of the toner, and the like.

<Fixing Process and Fuser Unit>

The present invention also relates to a fixing process for electrophotography. Said process comprises the steps of: fusing a toner forming an unfixed toner image on a recording medium by irradiation with a laser light beam, wherein said toner is the present toner mentioned above and said laser light beam has a wavelength within an absorption band of the colorant contained in said toner; and fixing said toner image onto said recording medium by re-solidifying said toner by for example, spontaneous cooling.

The fixing process is carried out with the below-mentioned fuser unit according to the invention.

The present invention also relates to a fuser unit for electrophotography. Said fuser unit comprises a laser light source for emitting a laser light beam to an unfixed toner image on a recording medium, thereby heat-fusing a toner forming said toner image, wherein said toner is the present toner mentioned above, and said laser light beam has a wave length within an absorption band of the colorant contained in said toner.

In an embodiment, the fuser unit does not comprise a non-laser light source for irradiating a toner forming said toner image with a light beam.

In the fixing process and the fuser unit, since such a toner not substantially comprising an infrared-absorbent is fused by laser light only, it is possible to provide a fixed toner image with good color reproducibility at low cost.

The present fuser unit will be now described specifically with reference to FIG. 1.

FIG. 1 is a schematic illustration showing an embodiment of a fuser unit according to the invention. The illustrated laser fuser unit 80 comprises a laser light source 81, which generates a laser light beam, and a rotatable polygon mirror 82, which reflects the laser light beam emitted by the light source 81 to an endless belt 61, so that its surface is scanned by and exposed to the laser light beam.

The laser light source 81 can emit independently four laser light beams having different oscillation wavelengths. The rotatable polygon mirror 82, such as a regular hexagonal prism, rotates at a constant rate in the direction indicated by an arrow.

The endless belt 61 is mounted around a drive roller 62 and a driven roller 63. The drive roller 62 can be rotated by a drive unit (not shown) around the rotational axis. The rotation of the drive roller 62 drives the endless belt 61 to rotate around the rollers in the direction indicated by an arrow. The driven roller 63, which rotates as the endless belt 61 rotates, provides tension to the belt so as not to loosen it.

In the optical path between the laser light source 81 and the polygon mirror 82, an optical lens can be provided, such as a collimator lens, a cylindrical lens or the like. Between the rotatable polygon mirror 82 and the endless belt 61, an optical lends and/or a mirror can be provided, such as an fθ lens, a folding mirror, a reflection mirror or the like.

The laser fuser unit 80 irradiates the toners on a paper sheet P with the laser beams from the laser light source 81, so that the toners are fused and then fixed onto the paper sheet in a non-contact manner. The laser fuser unit 80 irradiates the paper sheet P with the laser light beam locally in regions wherein toner images are formed.

According to the color toners to be fixed, the laser light source 81 comprises laser light units for the respective color toners. In the case of using yellow, magenta and cyan toners for example, the laser light source 81 comprises a laser light unit for yellow toner (Y-laser unit) 81Y, a laser light unit for magenta toner (M-laser unit) 81M, a laser light unit for cyan toner (C-laser unit) 81C, a laser light unit for black toner (K-laser unit) 81K.

The Y-laser unit 81Y emits a light beam having a wavelength corresponding to an absorption peak of the yellow toner (i.e., a peak absorption wavelength of the colorant contained in the yellow toner; 430 nm for example) in the visible region.

The M-laser unit 81M emits a light beam having a wavelength corresponding to an absorption peak of the magenta toner (i.e., a peak absorption wavelength of the colorant contained in the magenta toner; 565 nm for example) in the visible region.

The C-laser unit 81C emits a light beam having a wavelength corresponding to an absorption peak of the cyan toner (i.e., a peak absorption wavelength of the colorant contained in the cyan toner; 620 nm for example) in the visible region.

The K-laser unit 81K emits a light beam having a wavelength corresponding to an absorption peak of the black toner. The wavelength of the light beam emitted from the K-laser unit 81K is not limited and can be selected appropriately.

Preferably, the laser intensity rages from 1.5 to 630 W/cm$^2$. If it is less than 1.5 W/cm$^2$, the toner is fused only insufficiently by laser light, resulting in poor fastness. If the intensity is more than 630 W/cm$^2$, the toner and/or the recording paper P is burned by laser light, also resulting in poor fastness.

The laser light beam from the Y-laser unit 81Y scans, via the rotary polygon mirror 82, the surface of the recording paper P passing through the laser fuser unit and thus the toners on the paper are irradiated with the laser light beam. Since the light beam from the Y-laser unit 81Y has a wavelength corresponding to an absorption peak of the yellow toner used, the yellow toner is heat-fused by selectively absorbing the light beam.

Next, the laser light beam from the M-laser unit 81M scans, via the mirror 82, the surface of the paper P and thus the toners on the paper are irradiated with the light beam. Since the light beam from the M-laser unit 81M has a wavelength corresponding to an absorption peak of the magenta toner used, the magenta toner is heat-fused by selectively absorbing the light beam.

Subsequently, the laser light beam from the C-laser unit 81C scans, via the mirror 82, the surface of the paper P and thus the toners on the paper are irradiated with the light beam. Since the light beam from the C-laser unit 81C has a wavelength corresponding to an absorption peak of the cyan toner used, the cyan toner is heat-fused by selectively absorbing the light beam.

Lastly, the laser light beam from the K-laser unit 81K scans, via the mirror 82, the surface of the paper P and thus the toners on the paper are irradiated with the light beam. Since the light beam from the K-laser unit 81K has a wavelength corresponding to an absorption peak of the black toner used, the black toner is heat-fused by selectively absorbing the light beam.

As described above, since the toners forming a toner image on the paper P are irradiated with the laser beams having wavelengths corresponding to absorption peaks of the respective toners, the toner image can be fixed efficiently and/or uniformly onto the paper, even if the toners do not substantially comprise infrared-absorbents. The toner images can be fixed with good fastness and without white spots, and the fixed toner image can have good color reproducibility.

<Image-Forming Apparatus>

Here is described an electrophotographic image-forming apparatus according to the present invention.

It should be noted that the present image-forming apparatus can be provided in any type of configuration and/or arrangement known in the art for electrophotographic image-forming apparatuses using an electrophotographic developers, so far as it uses the present developer described above as developer, and comprises a fuser unit using the present fixing process described above, such as the fuser unit described above.

The present image-forming apparatus comprises, for example, a photoreceptor, on the surface of which an electrostatic latent image is formed; a charger unit, which charges the surface of said photoreceptor; a light exposure unit, which forms said latent image on the surface of said photoreceptor; a developing unit, which stores the developer according to the invention and supplies said developer to said latent image so as to develop it into a toner image; an image transfer unit, which transfers said toner image onto a recording medium; a cleaner unit, which cleans the surface of said photoreceptor; and a fuser unit, which fuses the toners forming said toner image and fixes it onto said recording material according to the present image-fixing process described above.

The image-forming apparatus can be for example copiers, printers, facsimile machines and composite machines thereof.

Figure 2:
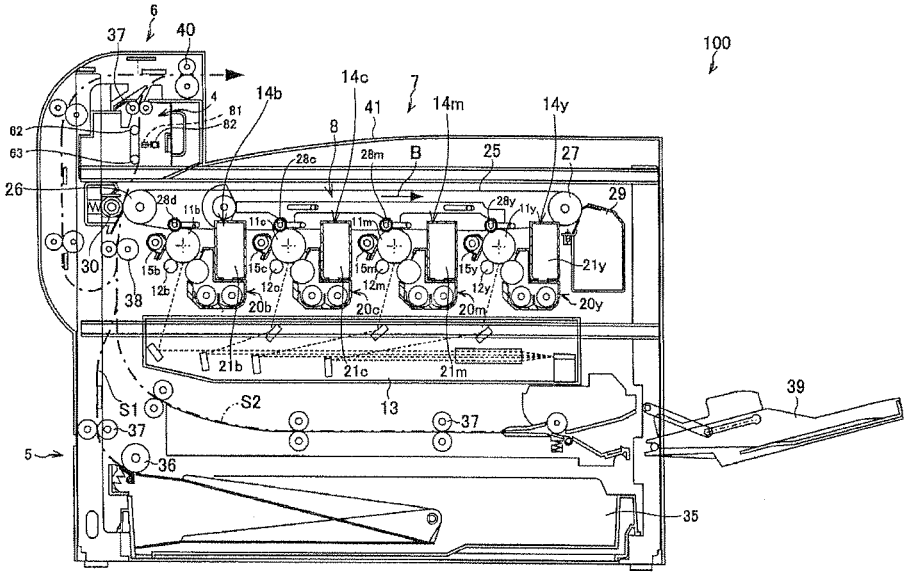
FIG. 2 is a schematic cross-sectional view illustrating an embodiment of an image-forming apparatus according to the invention.

The present image-forming apparatuses will be now described specifically with reference to FIG. 2.

FIG. 2 is a schematic illustration showing an embodiment of an image-forming apparatus according to the invention. The illustrated image-forming apparatus 100 is a composite machine having both facsimile and printing functions, which can form full color or monochrome images on a recording medium according to the received image information. More specifically, the apparatus 100 has three printing modes: copier mode, printer mode and facsimile machine mode, one of which is selected by a control unit (not shown) according to an operational information from an input unit (not shown) or a printing job received from a personal computer, a portable terminal, a storage medium or an external equipment using a memory device.

The apparatus 100 comprises a toner image-forming unit 7, a transfer unit 8, a fuser unit 4, a recording medium-feeding unit 5 and an ejection unit 6.

The image-forming unit 7 comprises four image-forming subunits that are respectively responsible for black (b), cyan (c), magenta (m) and yellow (y) image information included in color image information. Similarly, in the transfer unit 8, some of the members are provided in quadruplicate. The four subsets are distinguishably referred to by the reference number (7 or 8) followed by the alphabets "b" (for black), "c" (for cyan), "m" (for magenta) and "y" (for yellow). They are collectively referred to by the reference number alone.

(Toner Image-Forming Unit)

The toner image-forming unit 7 comprises four image-forming subunit, each comprising a photoreceptor drum 11, a charger subunit 12, a light-exposure subunit 13, a developing subunit 14, and a cleaner subunit 15.

Along the circumferential surface of the photoreceptor drum 11, arranged are the charger subunit 12, the developing subunit 14 and the cleaner subunit 15 in this order with respect to the rotation direction of the drum. The charger subunit 12 is arranged below the developing subunit 14 and the cleaner subunit 15 with respect to the vertical direction.

Photoreceptor

The photoreceptor 11 is rotatably supported by a drive member (not shown) so that it is driven to rotate around its rotation axis by the drive member. The photoreceptor comprises an electroconductive substrate and a photosensitive layer provided thereon (both not shown).

The substrate may be in any shape such as a solid or hollow cylinder, a thin sheet or the like. Preferred is a hollow cylindrical (or drum) substrate. The substrate is made with any electroconductive material.

Photosensitive Layer

The photosensitive layer is formed by layering a charge generation layer comprising a charge-generating material and a charge transport layer comprising a charge-transporting material in either order. It is preferable to provide a base coat layer between the substrate and the lower layer of the charge generation and transport layers. The base coat layer can smooth the surface of the photosensitive layer by covering the dents on the substrate, prevent from decreasing the chargeability of the photosensitive layer, and/or improve the charging characteristics of the photosensitive layer under low temperature and/or low humidity conditions. The photosensitive layer may further comprise a surface-protecting layer provided as the top layer, which is improved in the mechanical durability.

Charger Subunit

The charger subunit 12 is provided parallel to the longitudinal direction of the photoreceptor drum 11 so as to faces the circumferential surface of the drum with being spaced at a given distance. The charger subunit 12 charges the surface of the drum 11 at a given potential. The charger subunit 12 is a non-contact charger such as an injection charger, a pin array charger, a corona charger or the like.

Although in this embodiment, the charger subunit 12 and the drum 11 are arranged to be spaced, they can be provided in any other arrangements. In another embodiment, the charger subunit 12 is a contact charger that is in contact with the drum 11, such as a charged brush charger, a magnetic brush charger, a roller charger or the like. For example, in the case of using a charging roller, it is arranged to press against the drum 11.

Light-Exposure Subunit

The light-exposure subunit 13 is arranged in such a manner that the light beams, which are emitted from the light-exposure subunit according to the color image information, pass between the charger subunit 12 and the developing subunit 14 and reach the surface of the drum 11.

The exposure subunit 13 forms an electrostatic latent image on the surface of the drum 11 according to the color information in the following manner. In the exposure subunit 13, the color image information is separated into four sets of information: black color (b), cyan color (c), magenta color (m) and yellow color (y) information. According to the four sets of information, the exposure subunit 13 emits light beams to the surface of the drum 11, which have been previously charged uniformly by the charger subunit 12. In the portions of the surface that are exposed to the light beams, the surface charge is erased, thereby forming the latent image on the surface of the drum.

Figure 3:
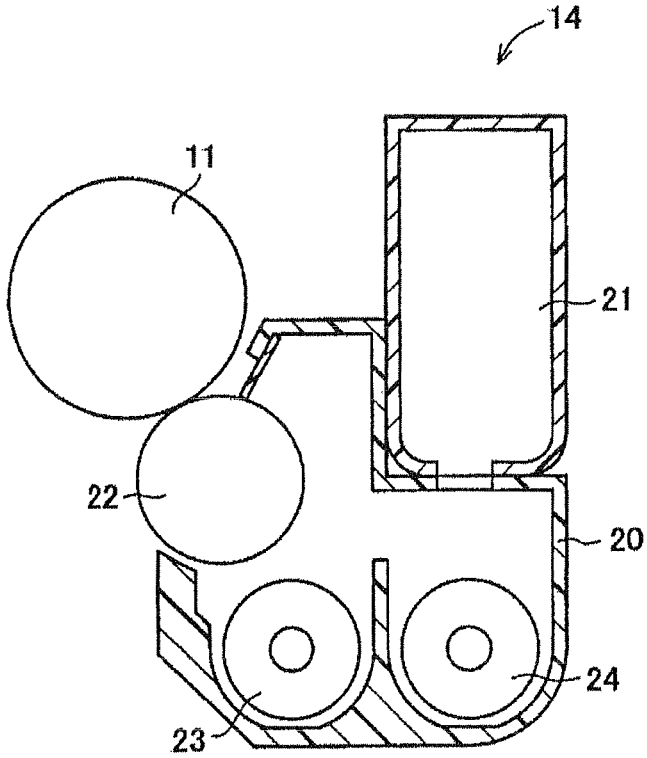
FIG. 3 is a schematic cross-sectional view illustrating a developing device used in an image-forming apparatus according to the invention.

As an example, the exposure subunit 13 comprises laser-emitting devices and a laser-scanning system with a set of reflection mirrors. It may comprise an LED (Light Emitting Diode) array or any appropriate combination of liquid-crystal shutters and light sources Developing Subunit The developing subunit 14 will be now described specifically with reference to FIG. 3, which illustrates its cross-sectional view.

The developing subunit 14 develops a latent image with a two-component developer comprising the toner according to the invention.

The developing subunit 14 comprises a developer tank 20, roller members such as a developing roller 22, a feed roller 23 and a stirring roller 24 or screw members, which are provided in the internal space of the tank and rotatably supported by the tank, and a toner hopper 21. The developer tank 20 is a container member for storing the developer in the internal space, and is provided with facing the surface of the drum 16. The tank 20 has an opening that faces the circumferential surface of the drum 11. The developing roller 22 is provided with facing the drum 16 through the opining.

The developing roller 22 is a roller member for supplying the toner to the latent image on the surface of the drum 11 at the contact point with or the closest point to the drum, thereby developing the latent image into a visible toner image. In supplying the toner, to the surface of the developing roller 22, applied is a developing bias potential of the opposite polarity to that of the charge of the toner, thereby smoothly supplying the toner to the latent image. It is possible to adjust the amount of the toner to be supplied to the latent image by changing the developing bias potential.

The feed roller 23 is a roller member for feeding the developer to the vicinity of the developing roller 22, and is provided rotatably with facing the developing roller 22. The stirring roller 24 is a roller member for stirring and feeding to the vicinity of the feed roller 23, the developer comprising the toner supplied from the toner hopper 21 into the tank 20, and is provided rotatably with facing the feed roller 23. The toner hopper 21 is arranged in such a manner that its outlet port (not shown) at the lower portion is in communication with the inlet port (not shown) of the tank 20 at the upper portion. The hopper 21 feeds the toners according to the toner consumption in the tank.

The toners may be fed directly from the toner cartridges to the tank, not by the use of a toner hopper.

Cleaner Subunit

The cleaner subunit 15, as illustrated in FIG. 2, removes the remaining toners on the surface of the drum 11 after transferring the toner image onto the recording medium, so as to clean the surface of the drum 11. For example, the cleaner subunit 15 comprises a plate member such as a cleaning blade.

In the case where an organic photoreceptor is used, although the surface made mainly of a resin material is likely to be deteriorated by the chemical action of ozone generated by corona charging of the charger, the cleaner subunit 15 can abrade such a deteriorated surface so as to remove it from the photoreceptor gradually and reliably. Thus, in this embodiment, the problem of deteriorating the surface by ozone and the like has been practically solved, and consequently the potential of surface charge by charging operation can be maintained stably for a long period of time.

Although the cleaner subunit 15 is provided in this embodiment, it is not indispensable.

In the toner image-forming unit 7, the surface of the drum 11 is uniformly charged by the charger subunit 12, and then exposed to laser signal light emitted from the light-exposure subunit 13 according to the image information, thereby forming an electrostatic latent image. After the latent mage is developed by the developing subunit 14 with toners into a toner image, and transferred onto an intermediate transfer belt 25, the remaining toners on the surface of the drum 11 are removed off by the cleaner subunit 15. The above sequence of operation is repeated (Transfer Unit)

The transfer unit 8, provided above the drum 11, comprises the intermediate transfer belt 25, a drive roller 26, a driven roller 27, intermediate transfer rollers 28*b*, 28*c*, 28*m* and 28*y*, a transfer belt-cleaning subunit 29, and a transfer roller 30. The intermediate transfer belt 25 is an endless belt member, which is mounted and therefore rotatable around the drive roller 26 and the driven roller 27. The belt is driven by the drive roller 26 to rotate in the direction indicated by the arrow B.

At the position where the belt 25 is in contact with the drum 11, the intermediate transfer roller 28, which is provided oppositely to the drum with respect to the belt 25, applies to the belt 25 a transfer bias potential of the opposite polarity to that of the charge of the toners on the drum 11, thereby transferring the toner image onto the belt 25.

In the case of forming a full color image, the monochromatic toner images formed on the drum 11 are transferred sequentially onto the belt 25 so as to superimpose them into a full color toner image.

The drive roller 26 is arranged to be rotatable by a drive member (not shown) around the rotational axis. The rotation of the drive roller 26 drives the belt 25 to rotate around the driven roller 26 and driven roller 27 in the direction indicated by the arrow B. The driven roller 27, which rotates as the belt 25 rotates, provides tension to the belt 25 so as not to loosen it. The intermediate transfer roller 28 is arranged to press the belt 25 against the drum 11 and be driven to rotate by a drive member (not shown) around the rotational axis. The roller 28 is connected to a power source (not shown) for applying the transfer bias potential as described above, and functions to transfer the toner image on the drum 11 onto the belt 25.

The transfer belt-cleaning subunit 29 is provided oppositely to the driven roller 27 with respect to the intermediate transfer belt 25, with being in contact with the outer circumferential surface of the belt. Since any toners remaining on the belt 25 may contaminate the rear surface of the recording medium, the transfer belt-cleaning unit 29 removes and collects such toners from the surface of the belt 25.

The transfer roller 30 is arranged to press the belt 25 against the drive roller 26 and be driven to rotate by a drive member (not shown) around the rotational axis. In the nip point between the transfer roller 30 and the drive roller 26 (referred hereinafter to as "transfer nip point"), the toner image carried on the belt 25 is transferred onto the recording medium fed from the recording medium feed unit 5 (described in detail below). Then, the recording medium carrying the toner image is transported to the fuser unit 4.

As described above, in the transfer unit 8, the toner image is transferred from the drum 11 onto the belt 25 in the nip point between the intermediate transfer roller 28 and the drum 11, and then is conveyed by the rotation of the belt 25 in the direction indicated by the arrow B, to the transfer nip point, where the toner image is further transferred from the belt 25 onto the recording medium.

(Fuser Unit)

In the image-forming apparatus according to the invention, the fuser unit uses the present fixing process described above.

The fuser unit 4 is provided downstream from the transfer unit 8 along the path of the recording medium.

The fuser unit 4 is the same unit as the laser fuser unit 80 described in the section "Fixing process and Fuser unit".

(Recording Medium Feed Unit)

The recording medium feed unit 5, as shown in FIG. 2, comprises an automatic feed tray 35, a pick-up roller 36, feed rollers 37, paper stop rollers 38, and a manual feed tray 39. The automatic feed tray 35, provided in the image-forming apparatus 100 in the lower portion, is a container member for storing recording mediums. The recording mediums include plain copy papers, color copy papers, OHP sheets, postcards, and the like. The pick-up roller 36 picks up the recording mediums one by one from the automatic feed tray 35, and feeds them to the path of the recording medium S1. The feed rollers 37 are pairs of roller members for transporting the recording medium to the paper stop rollers 38. Each pair of the feed rollers presses against each other.

The paper stop rollers 38 is a pair of roller members, pressing against each other, for feeding the recording medium transported by feed rollers 37 to the transfer nip position, in synchronization with the toner image carried on the intermediate transfer belt 25. The manual feed tray 39 is a device for draw the recording medium fed manually into the apparatus 100. The recording medium drawn by the manual feed ray 39 is transported by feed rollers 37 along the path of the recording medium S2 to the paper stop rollers 38.

By the recording medium feed unit 5, the recording mediums are fed one by one from the automatic feed tray 35 or the manual feed tray 39 to the transfer nip position, in synchronization with the toner image carried on the intermediate transfer belt 25.

(Ejection Unit)

The ejection unit 6 comprises feed rollers 37, ejection rollers 40 and a receiving tray 41. The feed rollers 37 are provided downstream from the fix nip point along the path of the recording medium, and transport the recording medium on which the toner image has been fixed to the ejection rollers 40. The ejection rollers 40 eject the recording medium to the receiving tray 41, which is provided on a top surface of the apparatus 100 and stores the recording mediums on which the toner images have been fixed.

The image-forming apparatus 100 further comprises a control means (not shown). In an embodiment, the control means is provided in the apparatus in the upper portion, and comprises a storage unit, a computing unit, and a control unit.

The storage unit accepts and stores, for example, setting data from an operation panel (not shown) provided on a top surface of the apparatus, sensed data by sensors (not shown) provided in the apparatus at various positions, the image information from an external device, and/or the like. The storage unit also stores any programs for various operating means for determining the type of recording medium, for adjusting the amount of toners to be attached to latent images, for determining the toner fusing conditions, and others. The storage means is any of those commonly used in the art, including read only memories (ROM), random access memories (RAM), hard disk drives (HDD) and the like.

The external device is any of the electric or electronic devices that can form or obtain image information and are connectable to the apparatus 100, including computers, digital cameras, television receivers, video recorders, DVD (Digital Versatile Disc) recorders, HD-DVD (High-Definition Digital Versatile Disc) recorders, Blue-ray Disc recorders, facsimile machines, portable terminals and the like.

The computing unit retrieves the data (sensed data, image information, commands for forming images and others) and/or the programs from the storage unit so as to make various judgments. In response to the judgments, the control unit outputs control signals to the relevant devices so as to control them.

The control and computing units each comprise a processing circuit such as a microcomputer or a microprocessor having a central processing unit (CPU).

The control means may comprise a power source together with the processing circuit. The power source supplies electrical power not only to the control means but also any other units in the apparatus 100.

It will be appreciated by those skilled in the art that any changes or modifications could be made to the particular embodiments described above without departing from the scope of the invention. Therefore, it should be understood that the present invention is not limited to the embodiments described above.

EXAMPLES

The present invention will better understood with reference to the following examples, which are intended only to illustrate the invention, but are not intended to limit the scope of the invention in any way.

<Volume Average Particle Size>

For measuring a volume average particle size, an dispersion is used which is prepared by adding 20 mg of sample particles and 1 ml of alkylether sulfuric ester sodium to 50 ml of an electrolyte solution (ISOTON-II, Beckman Coulter Inc., U.S.A.), and then subjecting to sonication at a frequency of 20 kHz for 3 minutes on an ultrasonic distributor (UH-50; SMT Co., Ltd., Japan).

For 50,000 sample particles from the dispersion, the density volume size distribution is determined on Coulter Multisizer II particle size analyzer (Beckman Coulter Inc., U.S.A.) with an aperture diameter of 100 μm. From the distribution, the volume average particle size is calculated.

<Glass Transition Temperature (Tg) of Binder Resin>

A differential scanning calorimetry (DSC) curve is prepared by heating 1 g of a sample resin at a rate of 10° C./minute, according to the Japanese Industrial Standards (JIS) K7121-1987, on a differential scanning calorimeter (DSC220; Seiko Electronics Inc., Japan).

On the DSC curve, the glass transition temperature (Tg) is determined as the temperature at the intersection of the extension of the baseline that appears at the higher temperature side with respect to the endothermic peak corresponding to glass transition, with the tangential line, having the maximum slope, of the curve in the section from the rise to the top of the peak.

<Viscoelasticity of Toners>

As a dynamic stress is applied to sample toners at 1.0 Hz at a level of 50% strain by using a 20 mm-parallel plate, the storage and loss moduli are determined on a rheometer, Rheo-Stress RS75 (HAAKE, Germany).

1. Preparation of Two-Component Developers

Example 1

The toner materials used were:

a polyester resin (glass transition temperature: 60° C.) obtained with 1,4-cyclohexanedimethanol, ethylene oxide adduct (2.2 moles) of bisphenol A, terephthalic acid, as binder resin 89.0 parts by weight;

a colorant master batch (pigment: C.I. Pigment Blue; DIC Corporation, Japan): 5.0 parts by weight; and a metal alkylsalicylate (BONTRON E-84; Orient Chemical Industries, Ltd., Japan), as charge control agent 2.0 parts by weight.

After mixing in a mixer (Henschel mixer; Mitsui Mining Co., Ltd., Japan) for 10 minutes, the toner materials were melt-kneaded in a twin-screw extruder (PCM-30; Ikegai, Ltd., Japan).

The kneaded materials were roughly milled by a cutting mill (VM-16; Ryoko Industry, Japan), and then finely milled by an opposed jet mill. The resultant fine particles were classified with a rotary classifier (TSP separator; Hosokawa Micron Corporation, Japan) so as to obtain colored resin particles (base toner particles) having a volume average particle size of 6.0 μm.

The base toner particles and silica having a number average particle size of 12 nm (of 0.5% by weight with respect to the weight of the base toner particles) were mixed in Henschel mixer so as to obtain toner particles to which silica externally added.

As carrier, a ferrite core carrier having a volume average particle size of 45 μm was used. The toner and the carrier were mixed for 20 minutes in a V-type mixer (V-5; Tokuju Corporation, Japan) so as to obtain the two-component developer of Example 1 having the concentration of the toner in the developer of 7%.

Examples 2 to 3 and Comparative Examples 1 to 4

The developers of Examples 2 to 3 and Comparative Examples 1 to 4 were prepared as described above for the developer of Example 1 except that the binder resin compositions used for the base toner particles were changed respectively as indicated in Table 1.

2. Fastness Evaluation

Test solid images having an amount of toners attached of 1.2 mg/cm$^2$ (corresponding to two toner layers) were prepared by using the two-component toners of Examples and Comparative Examples on a commercially-available copier machine (MX-2700; Sharp Kabushiki Kaisha, Japan) with the fuser unit modified as shown in FIG. 1 (Y-laser unit emitting a laser beam at 430 nm; M-laser unit emitting a laser beam at 565 nm; C-laser unit emitting a laser beam at 620 nm; K-laser unit emitting a laser beam at 780 nm; laser power: 250 W/cm$^2$).

In a JIS L0849 type fastness test (testing method for color fastness to rubbing), the test images were rubbed with an ink eraser (LION RUBBER ERASER GAZA-SUNA, LION office Products Corp., Japan) with a load of 1 kg, at a rate of 14 mm/second in three back-and-forth motions.

The reflectance densities (image densities) of the test images were measured before and after rubbing treatment on a reflection densitometer (Macbeth RD-914, Gretag-Macbeth GmbH, Germany).

As an index of fastness, a "fixation ratio" was calculated according to the following formula (1):

$$\text{Fixation ratio}(\%)=[(\text{image density after rubbing})/(\text{image density before rubbing})]\times 100 \quad (1)$$

The fastness evaluation was based on the following criteria: "Excellent" if the fixation ratio is 80% or more; "Good" if the ratio is 70% or more but less than 80%; and "Bad" if the ratio is less than 70%.

3. Examination of Image Quality for White Spot Occurrence

The printed solid test images described above were examined for the occurrence of white spots before rubbing. The evaluation of the examination was based on the following criteria: "Excellent" if no white spots were found in the test image, "Good" if a several white spots were found, at the level the image quality was not problematic, and "Bad" if more than several white spots were found, at the level the image quality was problematic.

The results of the evaluations are given in Table 1.

TABLE 1

| | Materials | | | | Viscoelasticity of toners | | |
|---|---|---|---|---|---|---|---|
| Resin | TPA | TMAn | CHDM | BPAEO | Loss Modulus (at 110° C.) | Storage Modulus | tan δ |
| A | 100 | | 22 | 90 | 1.5E+04 | 1.0E+03 | 15.0 |
| B | 96 | 4 | 32 | 78 | 2.9E+04 | 1.5E+03 | 19.3 |
| C | 93 | 7 | 27 | 80 | 2.1E+03 | 2.5E+02 | 8.4 |
| D | 87 | 13 | 20 | 82 | 3.2E+04 | 5.0E+03 | 6.4 |
| E | 100 | | 40 | 70 | 1.9E+03 | 1.5E+02 | 12.7 |
| F | 100 | | — | 112 | 1.6E+04 | 1.5E+03 | 10.7 |
| G | 96 | 4 | — | 111 | 1.1E+04 | 1.2E+03 | 9.2 |

| | | Evaluation | |
|---|---|---|---|
| | Resin | Fastness (Fixation ratio) | Image quality (White Spot Occurrence) |
| Example 1 | A | 90: Excellent | Good |
| Example 2 | B | 80: Excellent | Excellent |
| Example 3 | C | 95: Excellent | Good |
| Comparative Example 1 | D | Bad | Excellent |
| Comparative Example 2 | E | 96: Excellent | Bad |
| Comparative Example 3 | F | 89: Excellent | Bad |
| Comparative Example 4 | G | 90: Excellent | Bad |

Note:
Material compositions are expressed in mole ratio.
TPA: Terephthalic acid;
TMAn: Trimellitic acid anhydride;
CHDM: 1,4-Cyclohexanedimethanol;
BPAEO: ethylene oxide adduct (2.2 moles) of bisphenol A Even when toners comprise a polyester binder resin comprising a polyhydric alcohol component derived from cyclohexanedimethanol, the toner images made with the toner are fixed with poor fastness if the loss modulus is greater than $3\times10^4$ Pa, and many white spots occur in the fixed toner images if the loss modulus is smaller than $1\times10^3$ Pa.

It is understood from the results that the toners of the Examples can be fixed with sufficient fastness by only laser-fixing and provide high quality toner images fixed without white spots.

What is claimed is:

1. A fixing process for electrophotography, comprising the steps of: fusing a toner forming an unfixed toner image on a recording medium by irradiation with a laser light beam, wherein said toner is the toner comprising a polyester resin as binder resin and a colorant, said polyester resin being the condensation product of at least one polyhydric alcohol with at least one polybasic acid, wherein said at least one polyhydric alcohol comprises cyclohexanedimethanol, said toner having a loss modulus of from $2\times10^3$ Pa to $3\times10^4$ Pa at 110° C. and being irradiated with only laser light for fixing, said toner further having a tan δ of not less than 8 nor more than 20 at 110° C., where the tan δ is a ratio of a loss modulus to a storage modulus, said laser light beam having a wavelength within an absorption band of the colorant contained in said toner; and fixing said toner image onto said recording medium by re-solidifying said toner.

2. The process of claim 1, wherein said polyhydric alcohol further comprises a bisphenol A alkylene oxide adduct.

3. The process of claim 1, wherein said colorant is selected from the group consisting of cyan, magenta and yellow pigments and dyes.

4. The process of claim 1, wherein the toner does not substantially comprise an infrared-absorbent.

5. A fuser unit for electrophotography, comprising a laser light source for emitting a laser light beam to an unfixed toner image on a recording medium, thereby heat-fusing a toner forming said toner image, wherein said toner comprising a polyester resin as binder resin and a colorant, said polyester resin being the condensation product of at least one polyhydric alcohol with at least one polybasic acid, wherein said at least one polyhydric alcohol comprises cyclohexanedimethanol, said toner having a loss modulus of from $2\times10^3$ Pa to $3\times10^4$ Pa at 110° C. and being irradiated with only laser light for fixing, said toner further having a tan δ of not less than 8 nor more than 20 at 110° C., where the tan δ is a ratio of a loss modulus to a storage modulus, and said laser light beam has a wave length within an absorption band of the colorant contained in said toner.

6. The fuser unit according to claim 5, which does not comprise a non-laser light source for irradiating a toner forming said toner image.

7. An electrophotographic image-forming apparatus using an electrophotographic developer comprising said toner and comprising the fuser unit according to claim 5.

* * * * *